United States Patent [19]

Romoli

[11] 3,940,954

[45] Mar. 2, 1976

[54] ELECTRICAL SUPERVISORY CIRCUIT ARRANGEMENTS

[75] Inventor: Luciano Romoli, Florence, Italy

[73] Assignee: Billi S.p.A., Florence, Italy

[22] Filed: July 10, 1974

[21] Appl. No.: 487,395

[30] Foreign Application Priority Data

July 13, 1973 Italy ..... 9549/70

[52] U.S. Cl. ..... 66/157; 66/163; 318/373; 340/259; 340/267 R

[51] Int. Cl.[2] ..... D04B 35/14; D04B 35/18

[58] Field of Search ..... 66/163, 157, 161, 165, 66/166; 340/259, 267 R; 318/6, 373

[56] References Cited

UNITED STATES PATENTS

| | | | |
|---|---|---|---|
| 3,370,286 | 2/1968 | Buss | 340/259 |
| 3,388,255 | 6/1968 | May | 250/209 |
| 3,496,739 | 2/1970 | Motin et al. | 66/163 |
| 3,529,444 | 9/1970 | Romoli | 66/163 X |
| 3,602,727 | 8/1971 | Schwalm | 66/157 X |
| 3,659,437 | 5/1972 | McArthur et al. | 66/157 |
| 3,792,329 | 2/1974 | Kuhnlein | 318/373 X |

FOREIGN PATENTS OR APPLICATIONS

| | | | |
|---|---|---|---|
| 1,046,483 | 10/1966 | United Kingdom | 66/166 |

*Primary Examiner*—Wm. Carter Reynolds
*Attorney, Agent, or Firm*—Haseltine, Lake & Waters

[57] ABSTRACT

An electrical supervisory circuit arrangement, as for detecting faults such as yarn breakage in a circular knitting machine, comprises a number of channels each responsive to a particular type of fault signal in the machine. Each channel comprises a bistable transistor circuit which is switched in response to the particular fault condition to be detected and, when so switched, energises a warning light. In addition, all the bistable circuits are connected in common to an output transistor which is thus switched when any of the bistable circuits detects a fault. The output transistor controls two relays, one of which disconnects the forward-current supply to the machine and the other of which temporarily provides a reverse-current supply for braking the motor.

6 Claims, 1 Drawing Figure

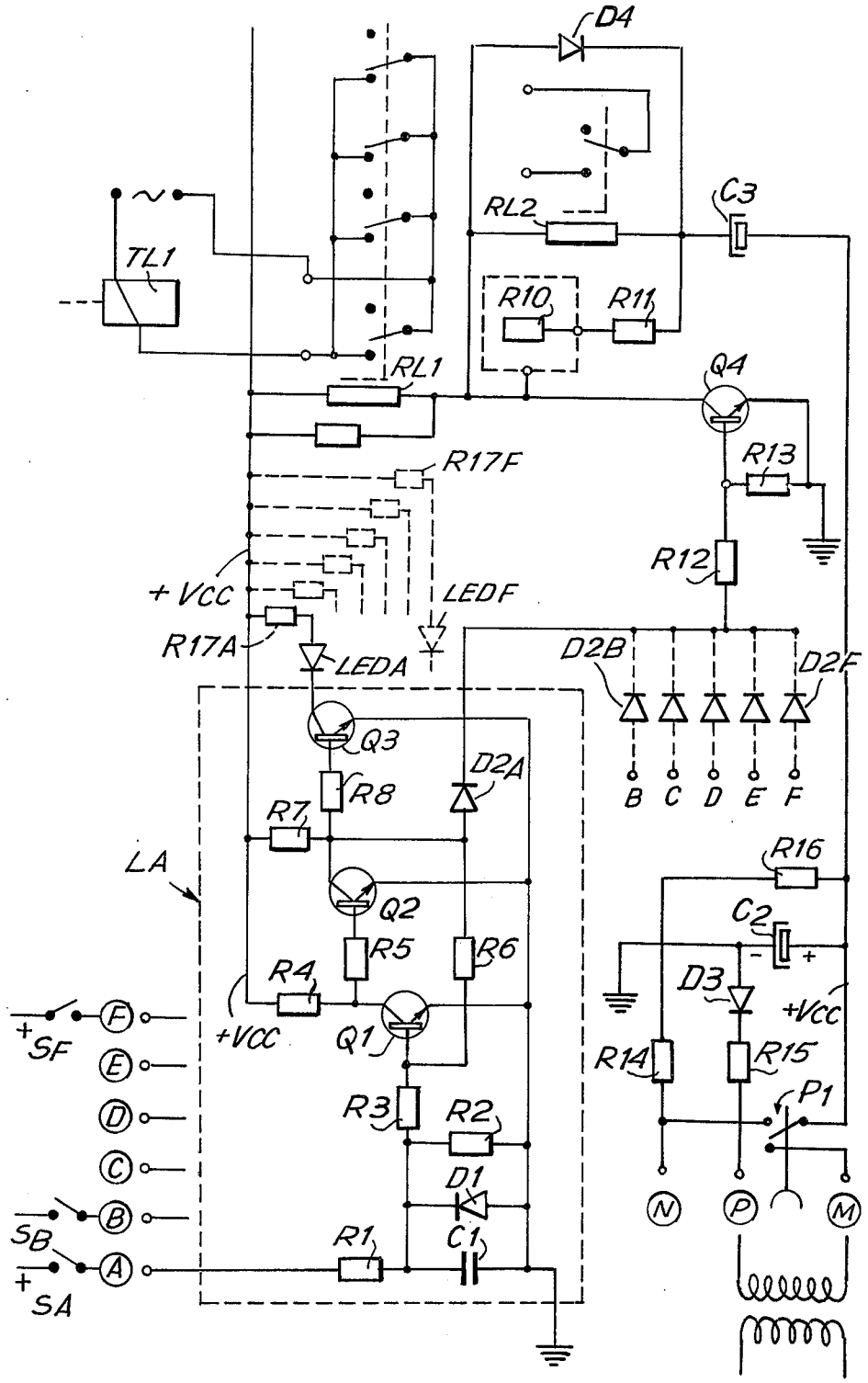
D4
RL2
C3
TL1
R10
R11
RL1
Q4
R17F
R13
R12
+VCC
LEDF
R17A
LEDA
D2B
D2F
Q3
D2A
R8
R7
B C D E F
LA
R16
Q2
C2
R5
R6
R4
D3
+VCC
+VCC
Q1
R14
R15
+SF
F
E
D
C
B
A
R3
R2
P1
D1
N
P
M
SB
R1
C1
+SA

ELECTRICAL SUPERVISORY CIRCUIT ARRANGEMENTS

BACKGROUND OF THE INVENTION

The invention relates to electrical supervisory circuit arrangements and more particularly to such circuit arrangements for monitoring the operation of a circular knitting machine (such as for knitting stockings) so as to stop the machine in the event of yarn breakage or other fault.

BRIEF DESCRIPTION OF THE INVENTION

According to the invention, there is provided an electrical supervisory circuit arrangement for monitoring fault conditions in a motor driven machine, comprising a plurality of bistable electronic circuits each responsive to a respective one of the fault signals so as to be switched thereby from a RESET to a SET state, means associated with each memory circuit to provide a respective visual indication when that memory circuit assumes its SET state, output means connected in common to all the memory circuits so as to be activated when any one or more of them assumes the SET state, means responsive to activation of the output means to interrupt the forward-current supply for the motor of the machine, means operative for a predetermined time interval and in response to activation of the output means to provide a temporary reverse-current electrical supply for the motor to arrest it rapidly, and means for resetting the memory circuits.

According to the invention, there is also provided an electrical supervisory circuit arrangement for automatically stopping the operation of a motor-driven circular stocking machine in the event of a fault which fault generates an electrical voltage pulse as by making an electrical short circuit to the structure of the machine, comprising a plurality of electronic memory circuits each responsive to a particular one of the fault signals and each comprising two transistors mutually connected to provide a bistable circuit which is switched from a RESET to a SET state in response to the fault signal, each memory circuit including a control transistor connected to energise a light emitting diode to signal switching of the memory circuit into the SET state, an output transistor connected to all the memory circuits to be switched in response to any of them switching into the SET state, a first relay connected to the output transistor to interrupt the forward-current supply to the motor of the machine in response to switching of the output transistor, and a second relay also connected to the output transistor and arranged to be temporarily supplied from a capacitor in response to switching of the output transistor whereby to temporarily provide a reverse-current supply for the motor to brake the latter, and means for short-circuiting an energising supply to the memory circuits for resetting them after correcting the electrical short circuit produced by the fault.

BRIEF DESCRIPTION OF THE DRAWING

An electrical supervisory circuit arrangement embodying the invention, and for detecting faults in a circular stocking machine, will now be described, by way of example only, with reference to the accompanying schematic circuit diagram of part of the circuit arrangement.

PREFERRED EMBODIMENTS

In the circuit arrangement to be described, there are six modules or channels, channels A, B, C, D, E, and F. In the circuit diagram, only the inputs of the channels B to F are shown, while channel A is illustrated in more detail. The actual circuitry of channels B to F can be the same as channel A.

The circuit arrangement to be described is able to detect and respond to faults such as, for example, yarn breakage with consequent radial orientation of the needle latches, breakage of a needle, error in the stocking size programming unit, chain breakdown, failure of forced air supply, or reserve channel, or other faults. Each of the faults to be detected is arranged to generate an electrical voltage pulse. These electrical voltage pulses may be generated by detecting switches, such as microswitches or switches operating by the needle latch. Occurrence of a fault may be arranged to cause a switch member to make contact with the mass of the machine which is held at a positive potential +Vcc and in this way there is generated a positive electrical voltage pulse. The electrical voltage pulses developed in response to faults may have a very short duration, for example down to about 0.1 milliseconds. As will be described, the circuit arrangement is arranged to stop the machine rapidly, in particular the needle cylinder, in response to the faults.

In the circuit diagram, the switches or other means generating the electrical fault signals are illustrated by the references $S_A$, $S_B$. . . $S_F$, each of the switches feeding a respective one of the channels A to F. The circuitry within the line $L_A$ relates to channel A alone, while the remainder of the circuitry illustrated is common to all the channels. Each of the channels includes its own circuitry corresponding to that shown within the block $L_A$.

The circuitry within the block $L_A$ includes a bistable circuit comprising transistors Q1 and Q2. The transistors Q1 and Q2 have their emitter and collector paths connected between a positive volt line carrying a voltage of +Vcc and a grounded line. When an electrical fault signal occurs at the input of channel A, caused by closure of the switch $S_A$, the base of transistor Q1, which is biased through a resistor R2, is driven positive through resistors R1 and R3, and the transistor conducts. Because of its load resistor R4, the potential at the collector of transistor Q1 falls substantially to zero and transistor Q2 is cut off because its base is driven towards zero via a resistor R5. A load resistor R7 of transistor Q2 causes the voltage at the collector of the transistor Q2 to rise substantially to +Vcc, and this potential is fed back through a resistor R6 to the base of transistor Q1 and holds that transistor conducting. The bistable circuit thus acts as a memory to record receipt of the electrical fault signal.

The bistable circuit is slightly asymmetric, that is, the value of resistor R6 is greater than that of resistor R5, and the value of resistor R7 is greater than that of resistor R4. This tends to bias the circuit into the RESET state in which transistor Q2 is conductive, and transistor Q1 is cut off, and this is the state which is initially assumed by the bistable circuit when the power supply is first switched on.

A capacitor C1 at the input of the bistable circuit suppresses spurious or parasitic signals which might falsely switch the bistable circuit, while a diode D1 protects against spurious pulses of negative polarity which could damage the base-emitter junction of the transistor Q1.

At the output of the bistable circuit, there is provided a control transistor Q3 whose base is driven from the collector of transistor Q2 through a resistor R8. The collector of the transistor Q3 drives a light emitting diode LEDA through a resistor R17A. When transistor Q2 is cut off in response to receipt of a fault signal, as described, transistor Q3 is rendered conductive and energises the light emitting diode LEDA. This signals that the supervisory circuit arrangement has operated, and the fact that it is the diode LEDA which is illuminated identifies the fault as being the fault monitored by channel A.

The light emitting diodes may be of the gallium arsenide type. Such diodes have a number of advantages over more usual lamps, especially long life and insensitivity to impacts and vibrations.

It will be appreciated that the transistors Q3 of each of other channels drives its own respective light emitting diode LEDB . . . LEDF via a respective resistor R17B . . . R17F.

The circuit arrangement also includes an output transistor Q4 whose emitter-collector path is connected between the +Vcc line and ground through a relay coil RL1, and which has a bias resistor R13. The base of transistor Q4 is connected via a resistor R12 and a diode D2A to the collector of the transistor Q2 in the channel A. In parallel with this, the base of transistor Q4 is also connected through the resistor R12 and respective diodes D2B . . . D2F to the transistors Q2 (not shown) of the other channels. Therefore, when any of the transistors Q2 is cut off, in response to a fault, transistor Q4 is rendered conductive and energises relay coil RL1. The consequent closure of the latter's contacts energises a separately fed a.c. switch TL1, and the latter interrupts the forward-current supply to the machine motor (not shown).

In addition, the circuitry includes a resistor RL2 which is connected at one side to the collector of transistor Q4 and at the other side to a capacitor C3 which is charged from a +Vcc line and is in circuit with a resistor R16. Therefore, when transistor Q4 conducts, relay coil RL2 is momentarily energised from the capacitor C3. The relay contacts (not shown in detail) of relay coil RL2 are arranged to reverse the phase connections of the machine motor and supply it with a reverse current supply to quickly arrest the motor. A resistor R11 and a potentiometer R10 shunt the relay coil RL2 and enable the on-time of the relay to be adjusted to the order of some tenths of a second.

A power supply for the circuit arrangement is generated by a rectifier circuit. Terminals P and M are energized from a mains supply through a transformer. A diode D3 which is connected to the terminal P through a limiting resistor R15, peak-charges an electrolytic capacitor C2 to produce the voltage +Vcc. The positive terminal of the capacitor C2 is connected (by a suitable connection not shown) to the metallic machine structure while its negative terminal provides electrical ground for the circuit arrangement.

For resetting the memory circuits into their quiescent or RESET states after the machine has been stopped and the appropriate fault switch $S_A$, $S_B$. . . $S_F$ has been opened after correction of the fault, a push-button P1 is provided. When the push-button is pressed, termainal M is disconnected from capacitor C2, and the latter is short-circuited through a resistor R14 in such a manner as to reduce the +Vcc line to zero volts. When the push-button P1 is released, the supply voltage is restored, and the memory circuits in the channels A to F re-assume their RESET states.

What I claim is:

1. An electrical supervisory circuit arrangement for monitoring fault signals produced by fault conditions in a motor-driven machine, comprising a plurality of bistable electronic memory circuits each responsive to a respective one of the fault signals so as to be switched thereby from a RESET to a SET state, means in each memory circuit for rendering it asymmetric whereby it tends to assume said RESET state in the absence of a fault signal, means connected to each memory circuit to provide a respective visual indication when that memory circuit assumes its SET state, output means connected in common to all the memory circuits so as to be activated when any one of them assumes the SET state, first control means connected to the output means and to the power supply for the motor of the machine and responsive to activation of the output means to interrupt the forward-current supply for the motor of the machine, second control means connected to the output means and to the power supply for the machine and operative for a predetermined time interval in response to activation of the output means to connect a temporary reverse-current electrical supply for the motor to arrest it rapidly, and means connected to the memory circuits for resetting them.

2. A circuit arrangement according to claim 1, in which the means for resetting the memory circuits comprises means for temporarily de-energising them.

3. A circuit arrangement according to claim 1, in which said second control means includes a relay having an operating coil, a capacitor arranged to be connected to said coil in response to activation of the said output means, and a circuit connected to the capacitor to pre-charge the capacitor.

4. In a motor-driven circular knitting machine connected to a power supply and arranged to generate an electrical voltage pulse fault signal in the event of occurrence of a fault in the machine, an electrical supervisory circuit arrangement comprising a plurality of electronic memory circuits each connected to respond to a particular one of the fault signals and each comprising two transistors mutually connected to provide a bistable circuit which is switched from a RESET to a SET state in response to the fault signal, a plurality of control transistors each connected to a respective one of the bistable circuits to be switched thereby in response to switching of the memory circuit into the SET state, and a plurality of light emitting diodes each connected to a respective one of the control transistors to be energised thereby when the latter is switched as aforesaid, an output transistor connected to all the memory circuits to be switched in response to any of them switching into the SET state, a first relay connected to the output transistor and to the machine power supply to interrupt forward-current supply to the motor in response to said switching of the output transistor, a second relay connected to the machine power supply to reverse the supply when energised, a capacitor having a pre-charging circuit, means connecting the second relay and the capacitor in circuit with each other to the output transistor whereby the second relay is temporarily energised by the capacitor in response to switching of the output transistor to temporarily provide a reverse-current supply for braking the motor, and means for de-energising the memory circuits to reset them.

5. In a circular knitting machine according to claim 4, a circuit arrangement including an adjustable resistance circuit connected to said second relay for adjusting its operating time.

6. In a circular knitting machine according to claim 4, a circuit arrangement in which each light emitting diode is a gallium arsenide diode.

* * * * *